US007919058B2

(12) United States Patent
Brons et al.

(10) Patent No.: US 7,919,058 B2
(45) Date of Patent: Apr. 5, 2011

(54) HIGH-SOLVENCY-DISPERSIVE-POWER (HSDP) CRUDE OIL BLENDING FOR FOULING MITIGATION AND ON-LINE CLEANING

(75) Inventors: Glen B. Brons, Phillipsburg, NJ (US); Chris A. Wright, Vienna, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/900,939

(22) Filed: Oct. 8, 2010

(65) Prior Publication Data

US 2011/0024260 A1 Feb. 3, 2011

Related U.S. Application Data

(62) Division of application No. 12/222,760, filed on Aug. 15, 2008, now Pat. No. 7,837,855.

(51) Int. Cl.
*C10G 45/00* (2006.01)

(52) U.S. Cl. ..... 422/211; 208/18; 208/19; 208/48 R

(58) Field of Classification Search ..... 208/18–19, 208/48 R

See application file for complete search history.

(56) References Cited

U.S. PATENT DOCUMENTS

| | | | |
|---|---|---|---|
| 4,655,903 | A | 4/1987 | Rahbe et al. |
| 4,853,337 | A | 8/1989 | Dickakian |
| 5,863,415 | A | 1/1999 | Zetlmeisl |
| 5,871,634 | A | 2/1999 | Wiehe |
| 5,997,723 | A | 12/1999 | Wiehe |
| 6,048,904 | A | 4/2000 | Wiehe et al. |
| 6,355,159 | B1 | 3/2002 | Myers |
| 6,706,669 | B2 | 3/2004 | Sartori et al. |
| 2004/0072361 | A1 | 4/2004 | Varadaraj et al. |
| 2004/0121472 | A1 | 6/2004 | Nemana et al. |
| 2006/0021907 | A1 | 2/2006 | Varadaraj et al. |
| 2006/0042661 | A1 | 3/2006 | Meyer et al. |
| 2006/0219266 | A1 | 10/2006 | Meyer |
| 2007/0023323 | A1 | 2/2007 | Van Den Berg et al. |

FOREIGN PATENT DOCUMENTS

WO 2008024323 A2 2/2008

OTHER PUBLICATIONS

Office Action, mailed Apr. 20, 2009, co-pending U.S. Appl. No. 11/506,901.

Carnahan, Norman F., "Properties of Resins Extracted From Boscan Crude Oil and Their Effect on the Stability of Asphaltenes in Boscan and Hamaca Crude Oils", Energy & Fuels, 1999, pp. 309-314, vol. 980218.

PCT International Search Report, Form PCT/ISA/210, mailed Nov. 27, 2009, 4 pgs.

PCT Written Opinion of the ISA, Form PCT/ISA/237, mailed Nov. 27, 2009, 7 pgs.

(Continued)

*Primary Examiner* — Robert J Hill, Jr.
*Assistant Examiner* — Brian McCaig
(74) *Attorney, Agent, or Firm* — Glenn T. Barrett

(57) ABSTRACT

A high solvency dispersive power (HSDP) crude oil is added to a blend of incompatible and/or near-incompatible oils to proactively address the potential for fouling heat exchange equipment. The HSDP component dissolves asphaltene precipitates and maintains suspension of inorganic particulates before coking affects heat exchange surfaces. HSDP co-blending for fouling mitigation and on-line cleaning can be affected using different concentrations of top-performing and moderate-performing HSDP crude oils.

7 Claims, 19 Drawing Sheets

OTHER PUBLICATIONS

The Oil Compatibility Model and Crude Oil Incompatibility, Wiehe and Kennedy, Energy & Fuels 2000, vol. 14, pp. 56-59, published Dec. 14, 1999.

Wiehe, Irwin A., "Fouling of Nearly Incompatible Oils", American Chemical Society, Journal, Energy & Fuels (2001), 15 (5), 1057-1058.

Wiehe, Irwin A., "Prevention of Fouling by Incompatible Crudes With The [Crude] Oil Compatibility Model", ALChE 1999 Spring National Meeting (Houston Mar. 14-18, 1999) Preprint N. 9.

International Search Report, PCT/US2009/053374, mailed Nov. 20, 2009.

Written Opinion, PCT/US2009/053374, mailed Nov. 20, 2009.

HIGH-SOLVENCY-DISPERSIVE-POWER (HSDP) CRUDE OIL BLENDING FOR FOULING MITIGATION AND ON-LINE CLEANING

CROSS REFERENCE TO RELATED APPLICATIONS

This application is a divisional application of U.S. patent application Ser. No. 12/222,760 filed Aug. 15, 2008, now U.S. Pat. No. 7,837,855, which relates to and claims priority from U.S. patent application Ser. No. 11/506,901, now U.S. Pat. No. 7,833,407, entitled "Method of Blending High TAN and High SBN Crude Oils and Method of Reducing Particulate Induced Whole Crude Oil Fouling and Asphaltene Induced Whole Crude Oil Fouling" filed Aug. 21, 2006, which is incorporated by reference in its entirety.

FIELD OF THE INVENTION

The present invention relates to processing of whole crude oils, blends and fractions in refineries and petrochemical plants. In particular, the present invention relates to the reduction of particulate induced crude oil fouling and asphaltene induced crude oil fouling. The present invention relates to the blending of high total acid number (TAN) and high solubility blending number ($S_{BN}$) crude oils to reduce fouling in pre-heat train exchangers, furnaces, and other refinery process units.

BACKGROUND OF THE INVENTION

Fouling is generally defined as the accumulation of unwanted materials on the surfaces of processing equipment. In petroleum processing, fouling is the accumulation of unwanted hydrocarbon-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers. Second, as deposition occurs, the cross-sectional area is reduced, which causes an increase in pressure drop across the apparatus and creates inefficient pressure and flow in the heat exchanger.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall. For example, the inventors have shown that a low-sulfur, low asphaltene (LSLA) crude oil and a high-sulfur, high asphaltene (HSHA) crude blend are subject to a significant increase in fouling when in the presence of iron oxide (rust) particulates, as shown for example in FIGS. 1 and 2.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Another common cause of rapid fouling is attributed to the presence of salts and particulates. Salts/particulates can precipitate from the crude oils and adhere to the hot surfaces of the heat exchanger. Inorganic contaminants play both an initiating and promoting role in the fouling of whole crude oils and blends.

Iron oxide, iron sulfide, calcium carbonate, silica, sodium and calcium chlorides have all been found to be attached directly to the surface of fouled heater rods and throughout the coke deposit.

Prolonged exposure to such surface temperatures, especially in the late-train exchanger, allows for the thermal degradation of the organics and asphaltenes to coke. The coke then acts as an insulator and is responsible for heat transfer efficiency losses in the heat exchanger by preventing the surface from heating the oil passing through the unit. Salts, sediment and particulates have been shown to play a major role in the fouling of pre-heat train heat exchangers, furnaces and other downstream units. Desalter units are still the only opportunity refineries have to remove such contaminants and inefficiencies often result from the carryover of such materials with the crude oil feeds.

Blending of oils in refineries is common, but certain blends are incompatible and cause precipitation of asphaltenes that can rapidly foul process equipment. Improper mixing of crude oils can produce asphaltenic sediment that is known to reduce heat transfer efficiency. Although most blends of unprocessed crude oils are not potentially incompatible, once an incompatible blend is obtained, the rapid fouling and coking that results usually requires shutting down the refining process in a short time. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils, blends and fractions in pre-heat train exchangers.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

The need exists to be able to prevent the precipitation/adherence of particulates and asphaltenes on the heated surfaces before the particulates can promote fouling and the asphaltenes become thermally degraded or coked. The coking mechanism requires both temperature and time. The time factor can be greatly reduced by keeping the particulates away from the surface and by keeping the asphaltenes in solution. Such reduction and/or elimination of fouling will lead to increased run lengths (less cleaning), improved performance and energy efficiency while also reducing the need for costly fouling mitigation options.

Some refineries and crude schedulers currently follow blending guidelines to minimize asphaltene precipitation and the resultant fouling of pre-heat train equipment. Such guidelines suggest blending crude oils to achieve a certain relationship between the solubility blending number ($S_{BN}$) and insolubility number ($I_N$) of the blend. The $S_{BN}$ is a parameter relating to the compatibility of an oil with different proportions of a model solvent mixture, such as toluene/n-heptane. The $S_{BN}$ is related to the $I_N$, which is determined in a similar manner, as described in U.S. Pat. No. 5,871,634, which is incorporated herein by reference. Some blending guidelines suggest a $S_{BN}/I_N$ blend ratio >1.3 and a delta ($S_{BN}-I_N$)>10 to minimize asphaltene precipitation and fouling. However, these blends are designed for use as a passive approach to minimizing asphaltene precipitation.

Attempts have been made to improve the method of blending two or more petroleum oils that are potentially incompatible while maintaining compatibility to prevent the fouling and coking of refinery equipment. U.S. Pat. No. 5,871,634 discloses a method of blending that includes determining the insolubility number ($I_N$) for each feedstream and determining the solubility blending number ($S_{BN}$) for each stream and combining the feedstreams such that the $S_{BN}$ of the mixture is greater than the In of any component of the mix. In another method, U.S. Pat. No. 5,997,723 uses a blending method in which petroleum oils are combined in certain proportions in order to keep the $S_{BN}$ of the mixture higher than 1.4 times the $I_N$ of any oil in the mixture.

These blends do not minimize both fouling associated with asphaltene and particulate induced/promoted fouling. There is a need for developing a proactive approach to addressing organic, inorganic and asphaltene precipitation and thereby minimize the associated foulant deposition and/or build up.

SUMMARY OF THE INVENTION

According to one aspect of the present invention, a method for on-line cleaning of a fouled crude oil refinery component is disclosed having the steps of operating a fouled crude oil refinery component, and feeding a blended crude oil to the fouled crude oil refinery component, the blended crude oil including a base crude oil and a predetermined amount of a high solvency dispersive power (HSDP) crude oil, the HSDP crude oil having a total acid number (TAN) of at least 0.3 mg KOH/g and a solubility blending number ($S_{BN}$) of at least 90. The crude oil refinery component can be a heat exchanger, furnace, distillation column, scrubber, reactor, liquid-jacketed tank, pipestill, coker, or visbreaker. The predetermined amount of HSDP crude oil can be from 3 to 50 percent of the total volume of the blended base crude oil. The base crude oil can be one of a whole crude oil or a blend of at least two crude oils.

According to another aspect of the present invention, a system capable of experiencing fouling conditions associated with particulate or asphaltene fouling is disclosed including at least one crude oil refinery component, and a blend in fluid communication with the at least one crude oil refinery component, the blend including a blend of a base crude oil and a predetermined amount of a high solvency dispersive power (HSDP) crude oil, the HSDP crude oil having a total acid number (TAN) of at least 0.3 mg KOH/g and a solubility blending number ($S_{BN}$) of at least 90. The crude oil refinery component can be a heat exchanger, furnace, distillation column, scrubber, reactor, liquid-jacketed tank, pipestill, coker, or visbreaker. The predetermined amount of HSDP crude oil can be from 3 to 50 percent of the total volume of the blended base crude oil. The base crude oil can be one of a whole crude oil or a blend of at least two crude oils.

These and other features of the present invention will become apparent from the following detailed description of preferred embodiments which, taken in conjunction with the accompanying drawings, illustrate by way of example the principles of the present invention.

BRIEF DESCRIPTION OF THE DRAWINGS

The invention will now be described in conjunction with the accompanying drawings in which.

In the drawings, like reference numerals indicate corresponding parts in the different figures.

Figure 1:
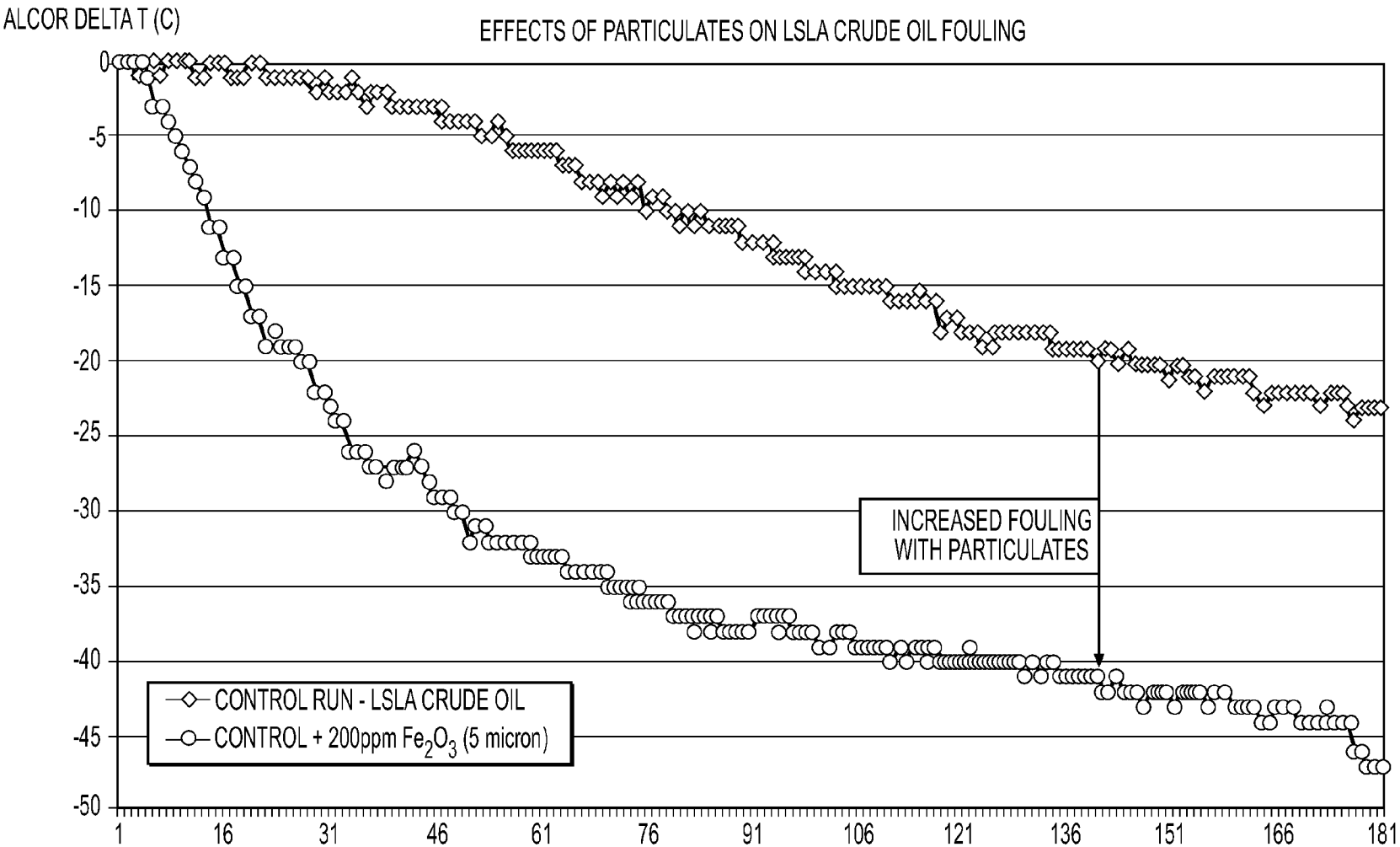
FIG. 1 is a graph illustrating the effects of particulates on fouling of a LSLA crude oil.

While the invention is capable of various modifications and alternative forms, specific embodiments thereof have been shown by way of the process diagrams and testing data shown in FIGS. 1-19, and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE INVENTION

Reference will now be made in detail to the various aspects of the present invention. The method and corresponding steps of the invention will be described in conjunction with the detailed description of the compositions.

The present invention will now be described in greater detail in connection with the figures. The present invention aims to reduce fouling in heat exchangers and other components located within a refinery. This aim is achieved by a blended base crude oil, which can consist of a whole crude oil, a blend of two or more crude oils or fractions thereof with a predetermined amount of a high solvency dispersive power (HSDP) crude oil. The addition of HSDP crude oil mitigates both asphaltene induced fouling and particulate induced/promoted fouling. The high $S_{BN}$ of these HSDP crude oils allows for the enhanced solubility of any asphaltenes in the rest of the crude oils and/or blends. A measured TAN is believed to indicate the presence of molecules that help disperse the particulates in the crude oil blend which prevents them from adhering to the heated surface. In order to achieve the reduction in fouling, the HSDP crude oil should have a total acid number (TAN) of at least 0.3 mg KOH/g. Higher TAN levels can result in improved fouling reduction and mitigation. The HSDP crude oil should have a solubility blending number ($S_{BN}$) of at least 90. Higher $S_{BN}$ levels can result in improved fouling reduction and mitigation. The volume of HSDP crude oil necessary in the blended crude oil will vary based upon the TAN and/or $S_{BN}$ values of the HSDP crude oil. The higher the TAN and/or $S_{BN}$ values of the HSDP crude oil, the lower the volume of HSDP crude oil necessary to produce a blended crude oil that will reduce and/or mitigate both asphaltene induced fouling and particulate induced fouling and/or promotion in refinery components, including but not limited to heat exchangers and the like. The HSDP crude oil preferably makes up between three percent and fifty percent of the total volume of the blended crude oil.

The blended crude oil is then processed within the refinery. The blended crude oil exhibits improved characteristics over the base crude oil. Specifically, the blended crude oil exhibits a significant reduction in fouling over base crude which contain particulates. This results in improved heat transfer within the heat exchanger and a reduction in overall energy consumption.

Figure 10:
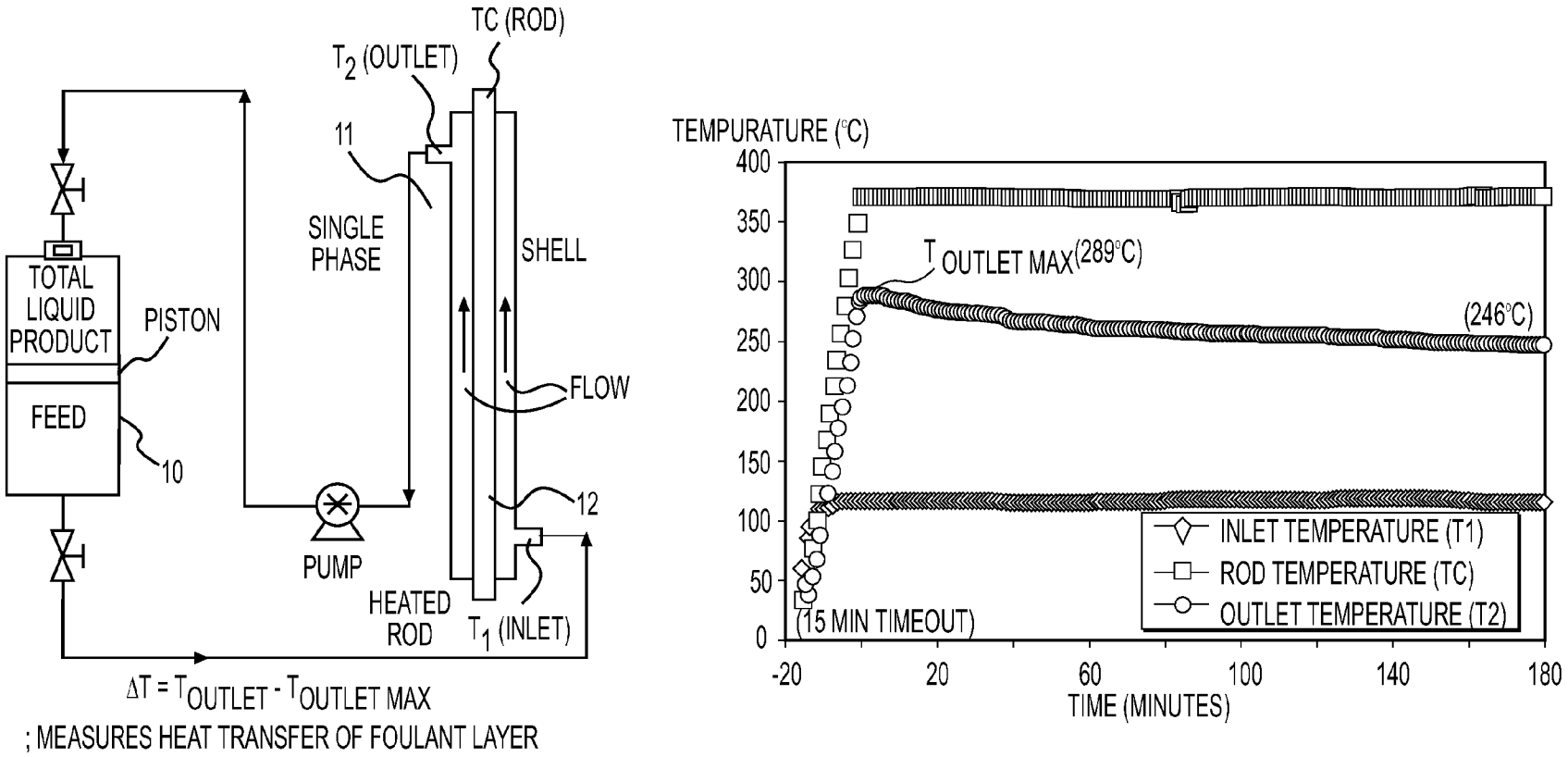
FIG. 10 is a schematic of an Alcor fouling simulator used in accordance with the present invention.

FIG. 10 depicts an Alcor testing arrangement used to measure what the impact the addition of particulates to a crude oil has on fouling and what impact the addition of a HSDP crude oil has on the reduction and mitigation of fouling. The testing arrangement includes a reservoir 10 containing a feed supply of crude oil. The feed supply of crude oil can contain a base crude oil containing a whole crude or a blended crude containing two or more crude oils. The feed supply can also contain a HSDP crude oil. The feed supply is heated to a temperature of approximately 150° C./302° F. and then fed into a shell 11 containing a vertically oriented heated rod 12. The heated rod 12 can be formed from a carbon steel. The heated rod 12 simulates a tube in a heat exchanger. The heated rod 12 is electrically heated to a predetermined temperature and maintained at such predetermined temperature during the trial. Typically rod surface temperatures are approximately 370° C./698° F. and 400° C./752° F. The feed supply is pumped across the heated rod 12 at a flow rate of approximately 3.0 mL/minute. The spent feed supply is collected in the top section of the reservoir 10. The spent feed supply is separated from the untreated feed supply oil by a sealed piston, thereby allowing for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface. The foulant deposits are thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid ΔT or ΔT and can be dependent on the type of crude oil/blend, testing conditions and/or other effects, such as the presence of salts, sediment or other fouling promoting materials. A standard Alcor fouling test is carried out for 180 minutes. The total fouling, as measured by the total reduction in outlet liquid temperature is referred to as ΔT180 or dT180.

Figure 2:
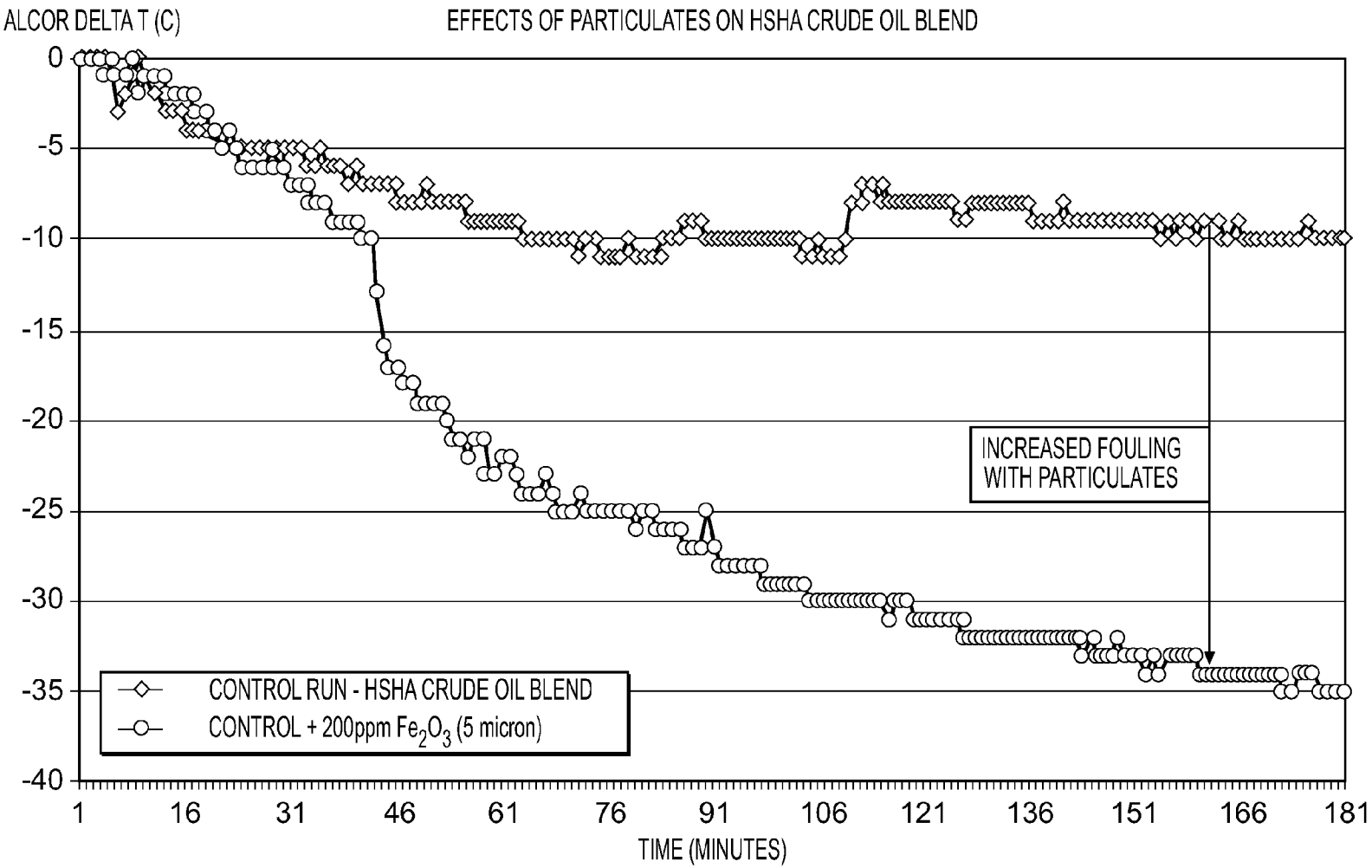
FIG. 2 is a graph illustrating the effects of particulates on fouling of a HSHA crude oil blend.

FIG. 1 and FIG. 2. illustrate the impact that the presence of particulates in a crude oil has on fouling of a refinery component or unit. There is an increase in fouling in the presence of iron oxide ($Fe_2O_3$) particles when compared to similar crude oils that do not contain particulates. The present invention will be described in connection with the use of a low-sulfur, low asphaltene or LSLA whole crude oil and a high-sulfur, high asphaltene or HSHA crude oil blend as base crude oil examples. These oils were selected as being representative of certain classifications of crude oil. The LSLA crude oil represents a low $S_{BN}$, high reactive sulfur and low asphaltenes crude oil. The HSHA blend crude oil represents a crude oil that is both high in asphaltenes and reactive sulfur. The use of these crude oils is for illustrative purposes only, the present invention is not intended to be limited to application only with LSLA crude oil and HSHA crude oil. It is intended that the present invention has application with all whole and blended crude oils and formulations of the same that experience and/or produce fouling in refinery components including but not limited to heat exchangers. The presence of fouling reduces the heat transfer of the heating tubes or rods contained within a heat exchanger. As described above, the presence of fouling has an adverse impact of heat exchanger performance and efficiency.

The present inventors have found that the addition of a crude oil having a high TAN and high $S_{BN}$ to the base crude oil reduces particulate-induced fouling. The degree of fouling reduction appears to be a function of the TAN measured on the overall blend. This is believed to be due to the ability of the naphthenic acids to keep particulates present in the blends from wetting and adhering to the heated surface, where otherwise promoted and accelerated fouling/coking occur. Most high TAN crude oils also have very high $S_{BN}$ levels, which have been shown to aid in dissolving asphaltenes and/or keeping them in solution more effectively which also reduces fouling that would otherwise occur due to the incompatibility and near-incompatibility of crude oils and blends. These crude oils are classified as high solvency dispersive power (HSDP) crude oils. There is a notable reduction in fouling when a predetermined amount of HSDP crude oil is added to the base crude, where the HSDP crude oil has a TAN as low as 0.3 mg KOH/g and a $S_{BN}$ as low as 90. The predetermined amount of HSDP crude oil can make up as low as three percent (3%) of the total volume of the blended crude oil (i.e., base crude oil+HSDP crude oil).

Figure 3:
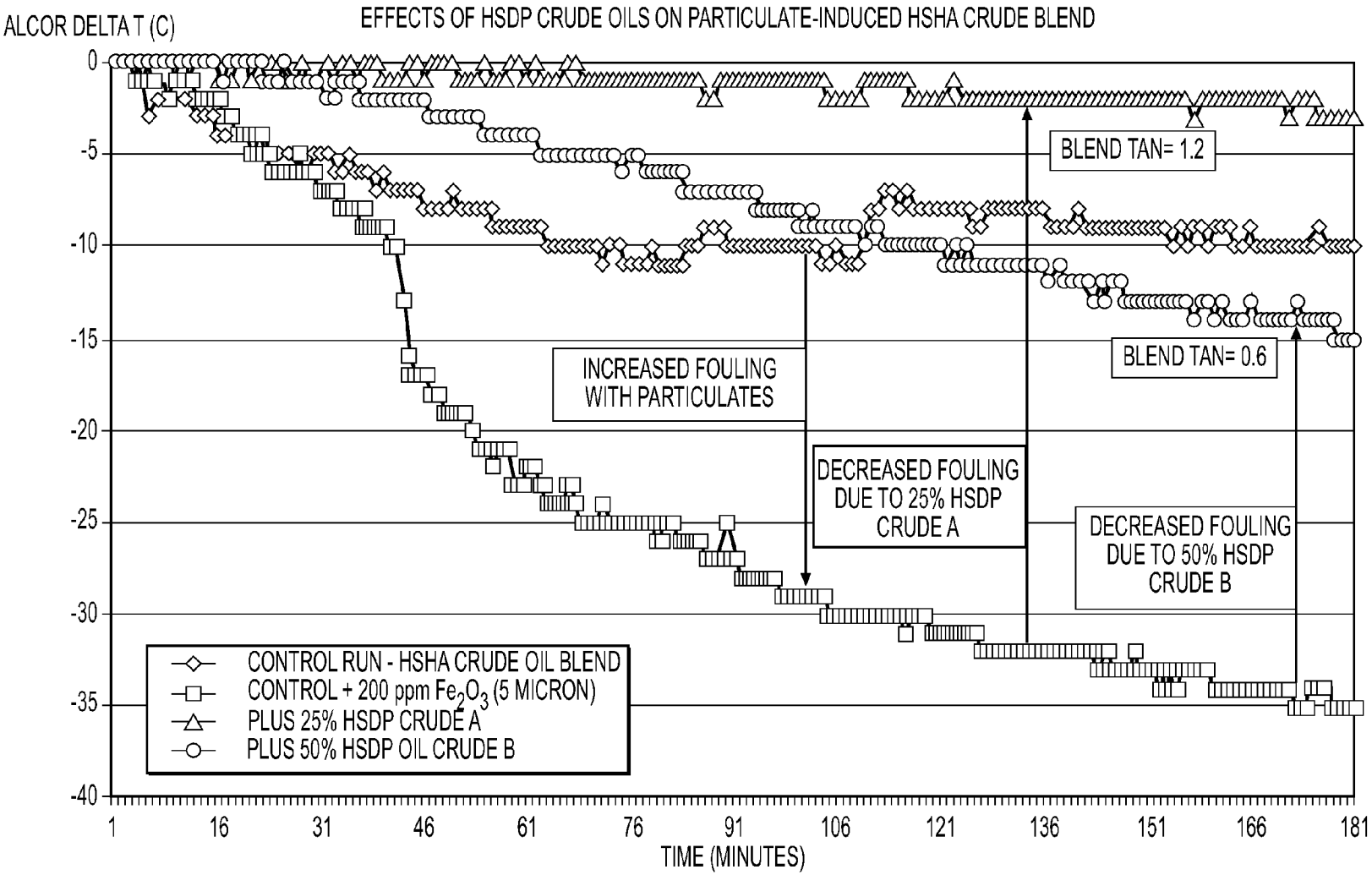
FIG. 3 is a graph illustrating test results showing reduced fouling associated with a HSHA crude oil blend when blended with a HSDP Crude Oil in accordance with this invention.

Sample tests were performed to determine the effect the addition of HSDP Crude Oils A and/or B to a HSHA base crude oil has on the fouling of the base oil. The results are illustrated in FIG. 3. FIG. 3 is a variation of FIG. 2 where the reduction in fouling associated with the addition of a predetermined amount of HSDP crude is blended with a base crude oil containing the HSHA crude oil. In one example, the base crude oil containing HSHA is blended with a HSDP crude oil, which accounts for twenty five percent (25%) of the total volume of the blended crude oil. The HSDP crude oil is labeled HSDP crude oil A having an approximate TAN of 4.8 mg KOH/g and a $S_{BN}$ of 112. As shown in FIG. 3, a significant reduction in fouling is achieved when compared to both base crude oil containing particulates and a base oil without particulates. In another example, the base crude oil containing HSHA is blended with a HSDP crude oil, which accounts for fifty percent (50%) of the total volume of the blended crude oil. The HSDP crude oil is HSDP Crude Oil B having an approximate TAN of 1.1 mg KOH/g and a $S_{BN}$ of 115. While the impact of the HSDP Crude Oil B on the fouling of the base crude oil is not as significant as the HSDP Crude Oil A, the HSDP Crude Oil B nonetheless produces a marked decrease in the fouling of a base crude oil containing particulates.

Figure 4:
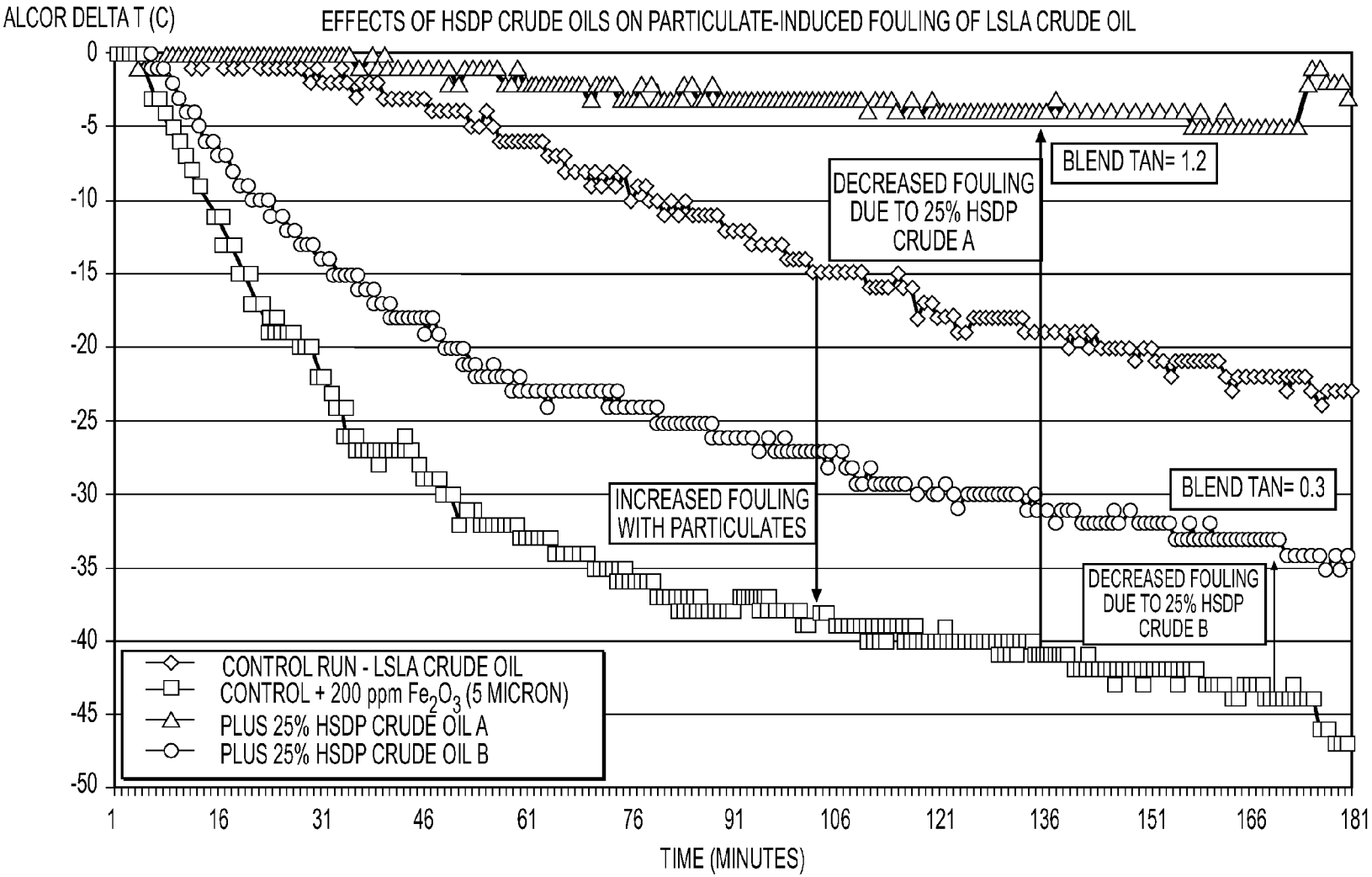
FIG. 4 is a graph illustrating test results showing reduced fouling associated with a LSLA crude oil when blended with a HSDP Crude Oil in accordance with this invention.

Sample tests were performed to determine the effect the addition of HSDP Crude Oils A and B on the fouling of the base oil. The results are illustrated in FIG. 4. FIG. 4 is a variation of FIG. 1 where the reduction in fouling associated with the addition of a predetermined amount of HSDP crude is blended with a base crude oil. In the illustrated examples, the base crude oil is a LSLA crude oil and is blended with HSDP Crude Oil A, which accounts for twenty five percent (25%) of the total volume of the blended crude oil. Like the addition of HSDP Crude Oil A to the HSHA crude oil, a significant reduction in fouling is achieved when compared to both base crude oil containing particulates and a base oil without particulates. In the other illustrated example, the LSLA base crude oil is blended with HSDP Crude Oil B, which accounts for fifty percent (50%) of the total volume of the blended crude oil. While the impact of the HSDP Crude Oil B on the fouling of the base crude oil is not as significant as the HSDP Crude Oil A, the HSDP Crude Oil B again produces a marked decrease in the fouling of a base crude oil containing particulates.

Figure 5:
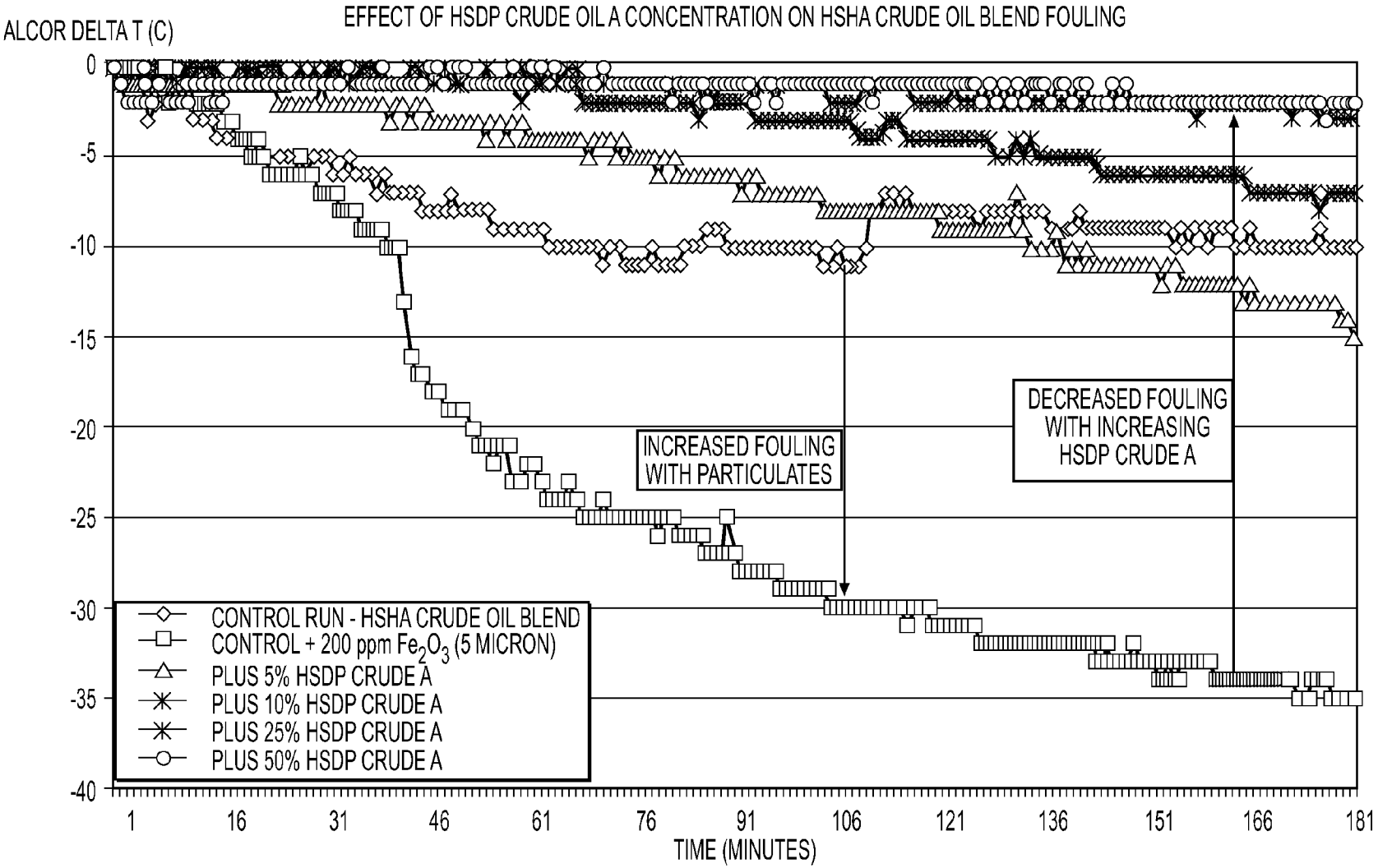
FIG. 5 is a graph illustrating test results showing reduced fouling associated with a HSHA crude oil blend when blended with HSDP Crude Oil A in accordance with this invention.
Figure 6:
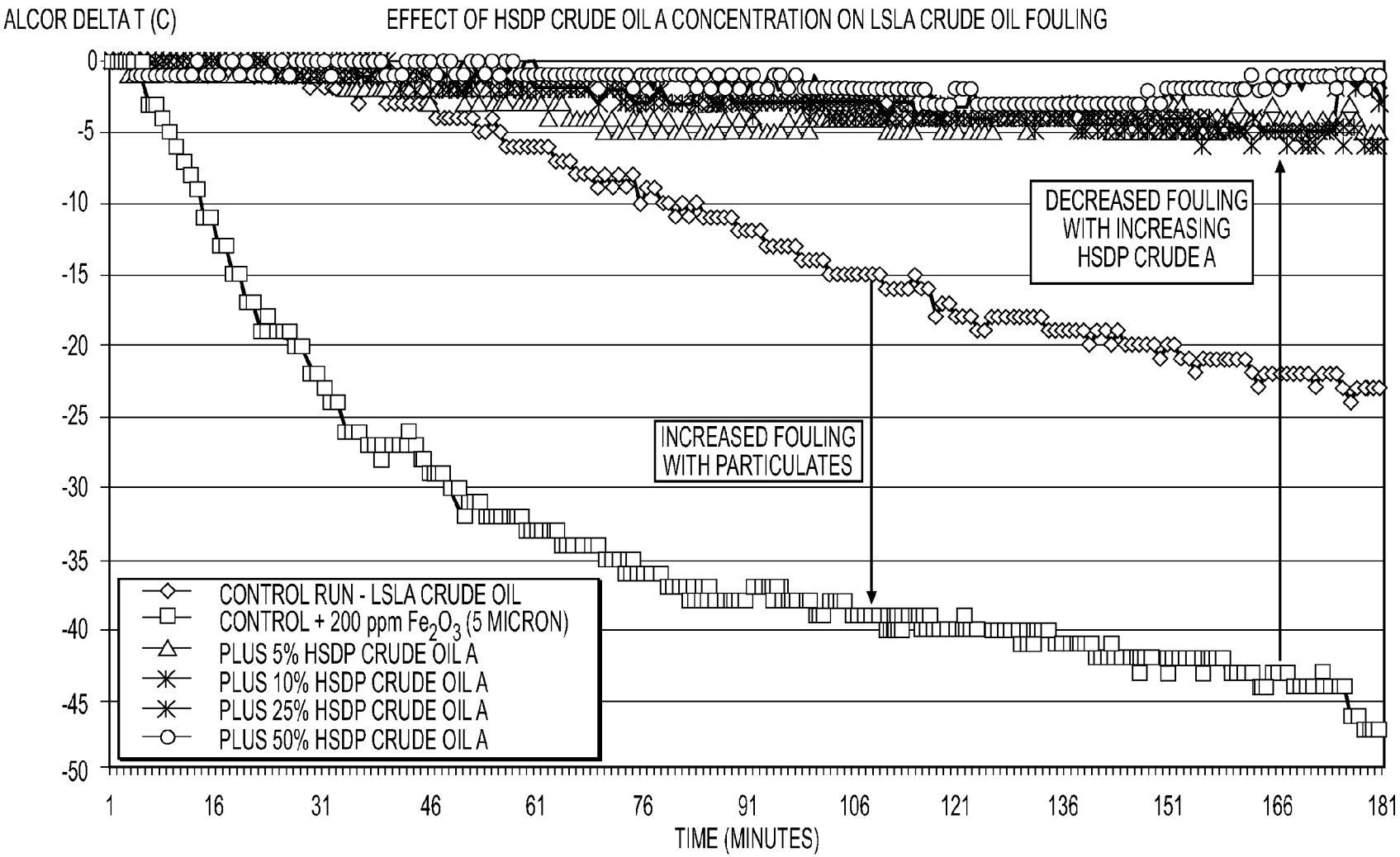
FIG. 6 is a graph illustrating test results showing reduced fouling associated with a LSLA crude oil when blended with HSDP Crude Oil A in accordance with this invention.
Figure 7:
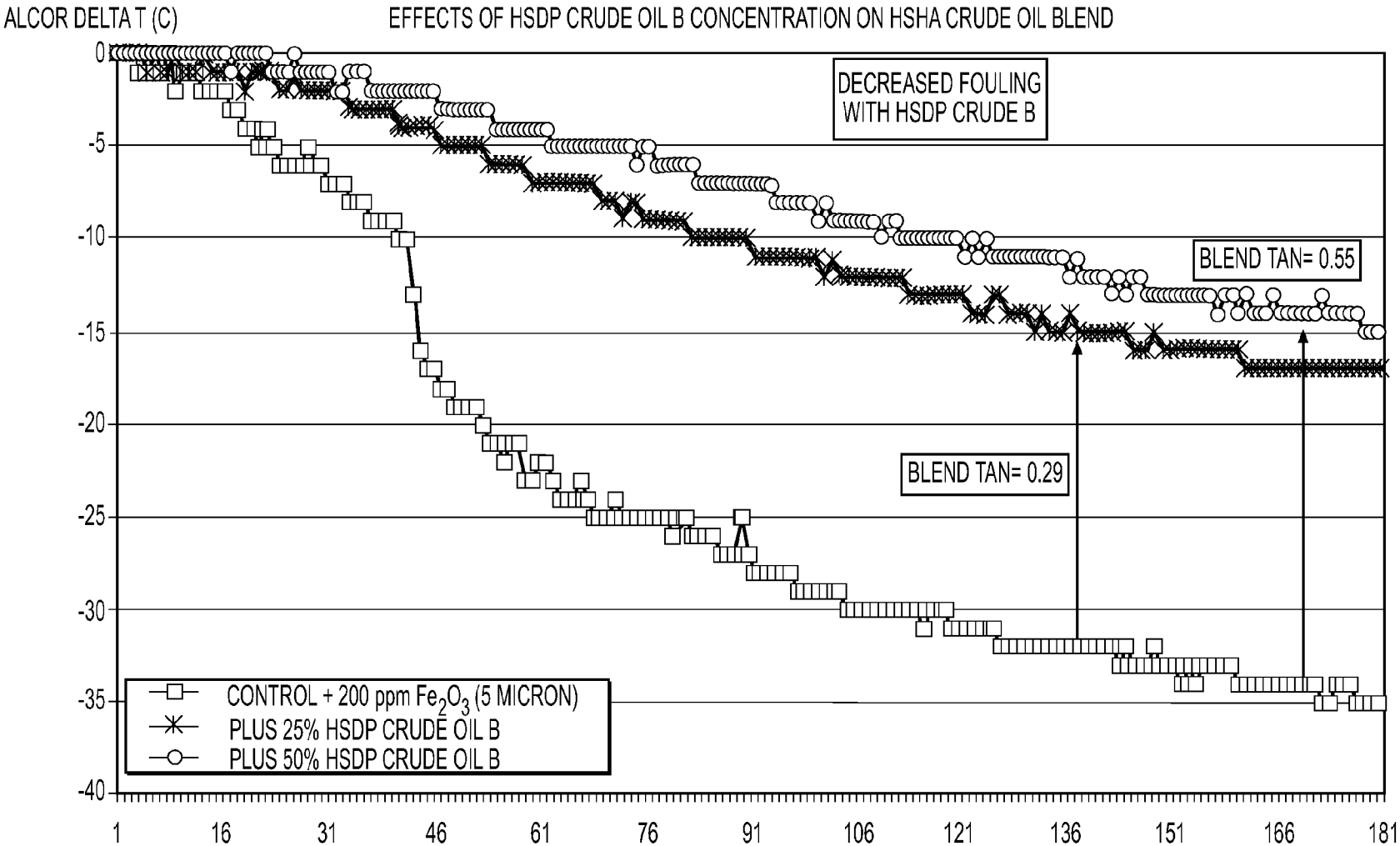
FIG. 7 is a graph illustrating test results showing reduced fouling associated with a HSHA crude oil when blended with HSDP Crude Oil B in accordance with this invention.
Figure 8:
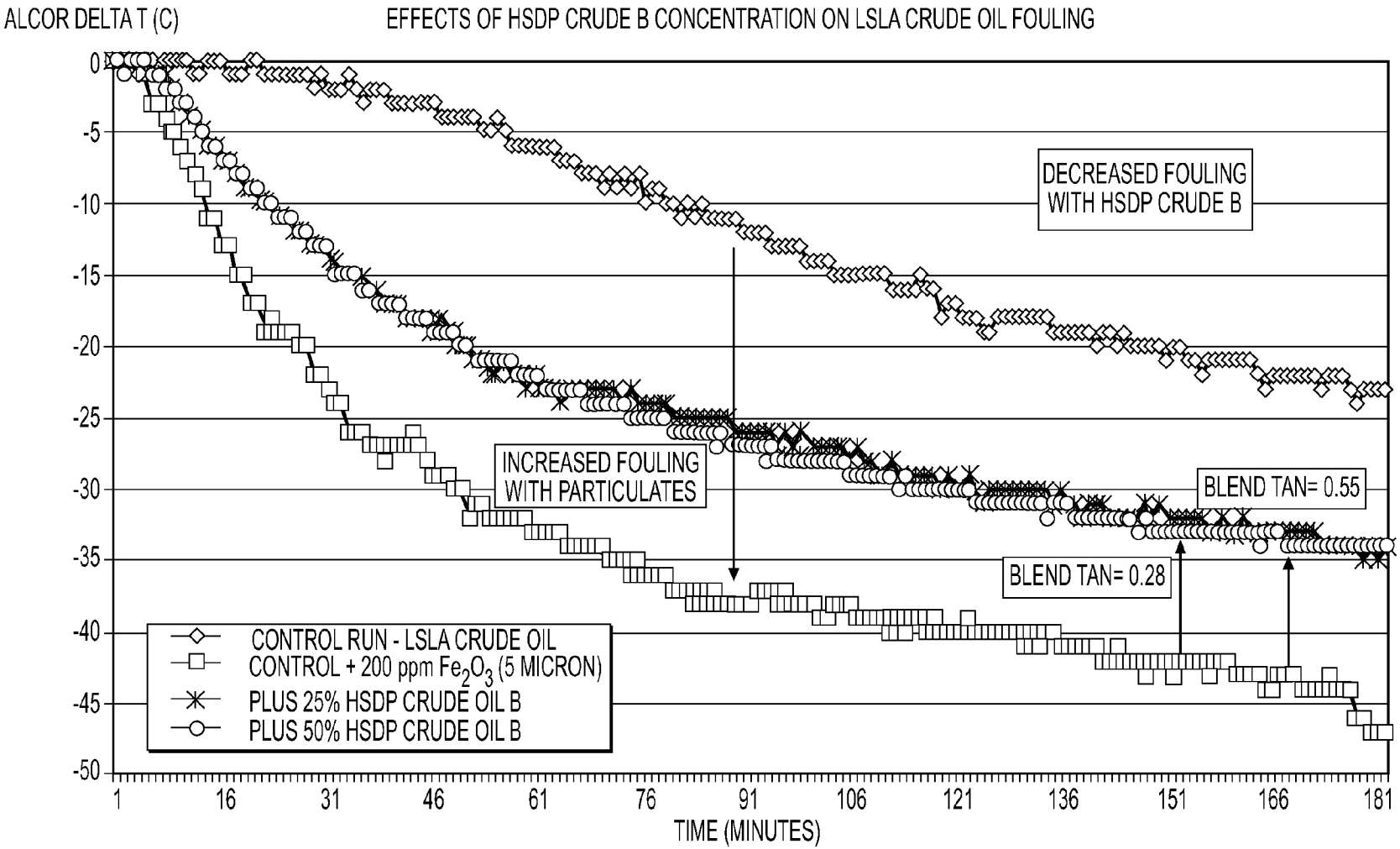
FIG. 8 is a graph illustrating test results showing reduced fouling associated with a LSLA crude oil when blended with HSDP Crude Oil B in accordance with this invention.

Sample tests were also performed to determine the effect the addition of the HSDP Crude Oil A to a base oil containing either LSLA whole crude oil or HSHA blended crude oil has on the fouling of the base oil. The HSDP A crude oil having an approximate TAN of 4.8 mg KOH/g and a $S_{BN}$ of 112. The results associated with the impact of the HSDP A on the HSHA blend are illustrated in FIG. 5. The results associated with the impact of the HSDP A on the LSLA whole crude oil are illustrated in FIG. 6. For both base oils, the addition of the HSDP A crude as the HSDP crude oil produced a reduction in fouling.

As shown in FIGS. 5-8, the reduction in fouling increased as the predetermined amount of HSDP crude oil content in the blended crude oil increased.

Figure 9:
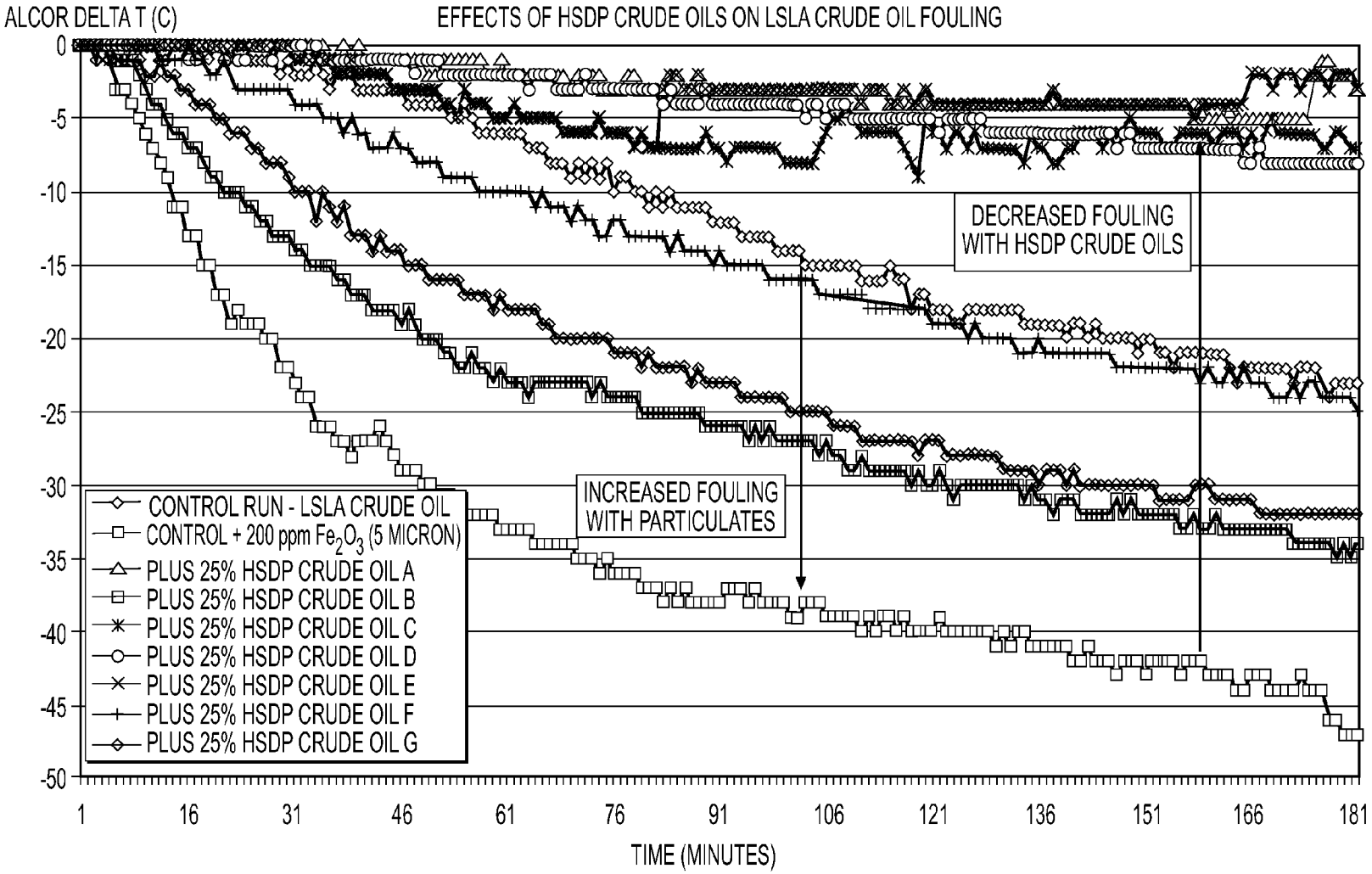
FIG. 9 is a graph illustrating test results showing reduced fouling associated with a LSLA crude oil when blended with a various HSDP Crude Oils (A-G) in accordance with this invention.

The above illustrative examples of the benefits of the present invention were based upon the use of examples A and B crude oils as the HSDP crude oil. The present invention is not intended to be limited to only these examples of HSDP crude oils. Other HSDP crude oils having an approximate TAN of at least 0.3 mg KOH/g and a $S_{BN}$ of at least 90 will achieve reductions in fouling. FIG. 9 illustrates the impact beneficial impact on fouling that the addition of various HSDP crude oils on a base oil of LSLA whole crude oil. As summarized in Table 1 below, the addition of HSDP crude oils resulted in a reduction in fouling when compared to base crude oil containing particulates.

TABLE 1

| Crude Mixture | TAN | $S_{BN}$ | ΔT180 |
|---|---|---|---|
| LSLA Crude (control) | — | — | −23 |
| +200 ppm FeO | — | — | −47 |
| +25% HSDP A | 4.8 | 112 | −3 |
| +25% HSDP B | 1.6 | 115 | −34 |
| +25% HSDP C | 1.6 | 158/127 | −7 |
| +25% HSDP D | 1.7 | 93 | −8 |
| +25% HSDP E | 0.6 | 120/132 | −3 |
| +25% HSDP F | 2.5 | 76 | −25 |
| +25% HSDP G | 2.8 | 112 | −32 |

In accordance with another aspect of the invention, a method is provided for on-line cleaning of a fouled crude oil refinery component. On-line cleaning of a fouled crude oil refinery component provides that the component does not need to be removed from service and it is not necessary to re-route crude oil to other refinery components. The method generally includes operating a fouled crude oil refinery component, and feeding a blended crude oil to the fouled crude oil refinery component. The blended crude oil including a base crude oil and a predetermined amount of a high solvency dispersive power (HSDP) crude oil, the HSDP crude oil having a total acid number (TAN) of at least 0.3 mg KOH/g and a solubility blending number ($S_{BN}$) of at least 90.

Laboratory fouling simulation tests have been performed to demonstrate and measure the differences in the capabilities of many HSDP crude oils to mitigate fouling. Those with a higher degree of effectiveness (measured at similar concentrations) are referred to as "top-performing" HSDP crude oils, wherein lower amounts of these crude oils generally are needed to achieve the desired fouling mitigation. Higher amounts of the other less effective ("moderate-performing") HSDP crude oils are required for blending to achieve the same levels of fouling reduction.

The $S_{BN}$ and TAN properties identify whether or not a crude oil is an HSDP. Alcor fouling simulation tests carried out with HSDP crude oils blended with known fouling crudes can be used to define relative HSDP performance, as well as to estimate the preferred concentrations desired to mitigate whole crude blend fouling.

Table 2 provides a list of crude oils that have been determined to have HSDP capability. The tested $S_{BN}$ and TAN levels are provided in Table 2. The relative performance of each HSDP crude oil was determined using Alcor fouling simulation tests following co-blending at 25% of the total volume with two different fouling control blends having 200 wppm particulates (<0.5 micron). The HSDP crude oils listed in Table 2 are provided for purpose of illustration and not limitation; additional HSDP crude oils also can be suitable for the present invention.

TABLE 2

| HSDP Crude Oil | $S_{BN}$ | TAN (mg KOH/g) | Relative Performance |
|---|---|---|---|
| A | 112 | 4.8 | Top |
| B | 127 | 1.6 | Top |

TABLE 2-continued

| HSDP Crude Oil | $S_{BN}$ | TAN (mg KOH/g) | Relative Performance |
|---|---|---|---|
| C | 120 | 0.6 | Top |
| D | 96 | 2.5 | Moderate |
| E | 112 | 2.8 | Top |
| F | 97 | 1.7 | Top |
| G | 119 | 2.8 | Top |
| H | 96 | 0.5 | Moderate |
| I | 99 | 0.3 | Moderate |
| J | 132 | 1.1 | Moderate |
| K | 111 | 2.4 | Moderate |
| L | 100 | 0.6 | Moderate |
| M | 97 | 0.5 | Moderate |
| N | 110 | 2.8 | Moderate |
| O | 99 | 1.0 | Moderate |
| P | 96 | 0.6 | Moderate |
| Q | 92 | 0.9 | Moderate |
| R | 95 | 0.9 | Moderate |

Figure 11:
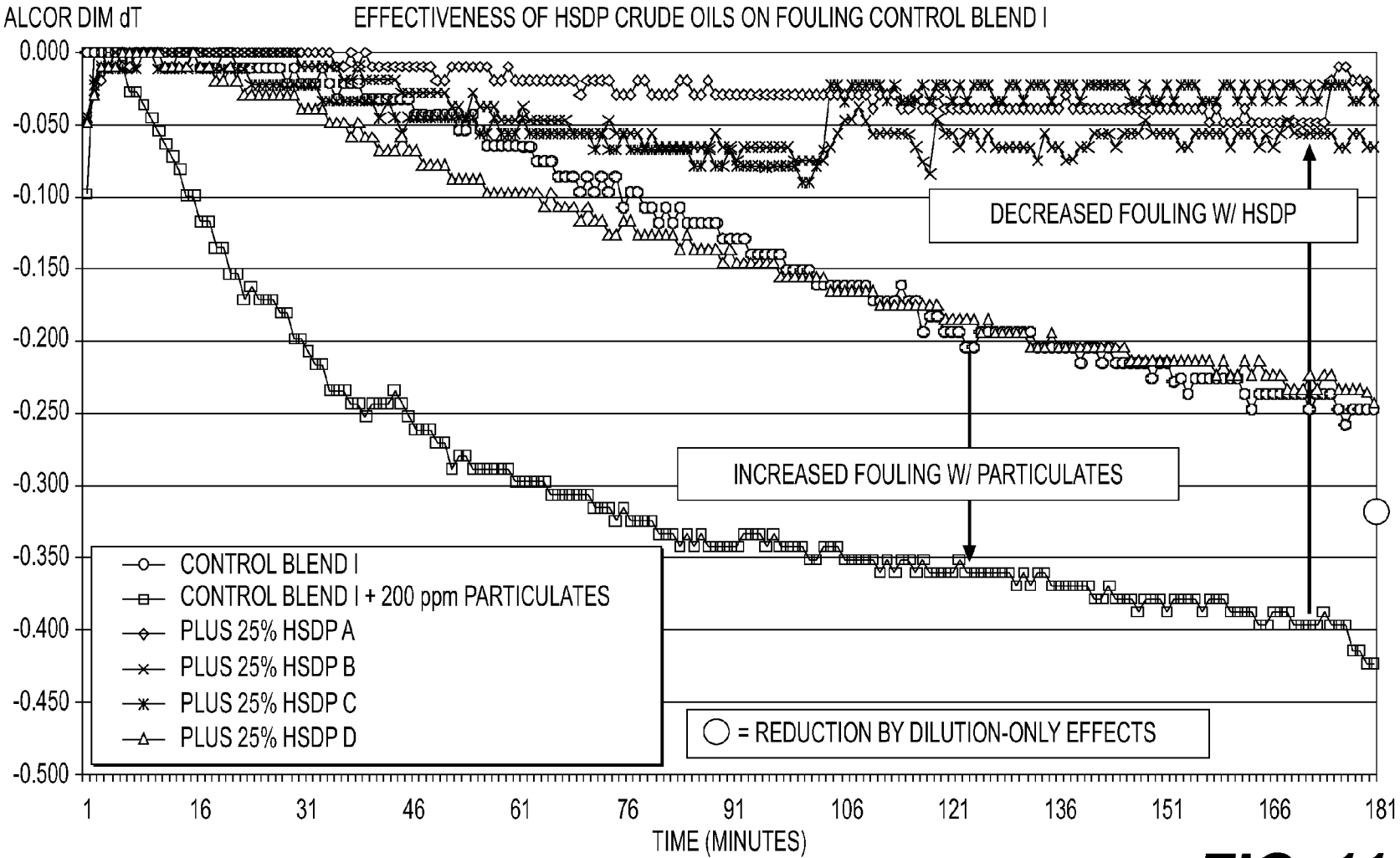
FIG. 11 is a graph illustrating test results showing reduced fouling associated with a crude oil fouling control blend when blended with a various HSDP Crude Oils (A-D) in accordance with this invention.
Figure 12:
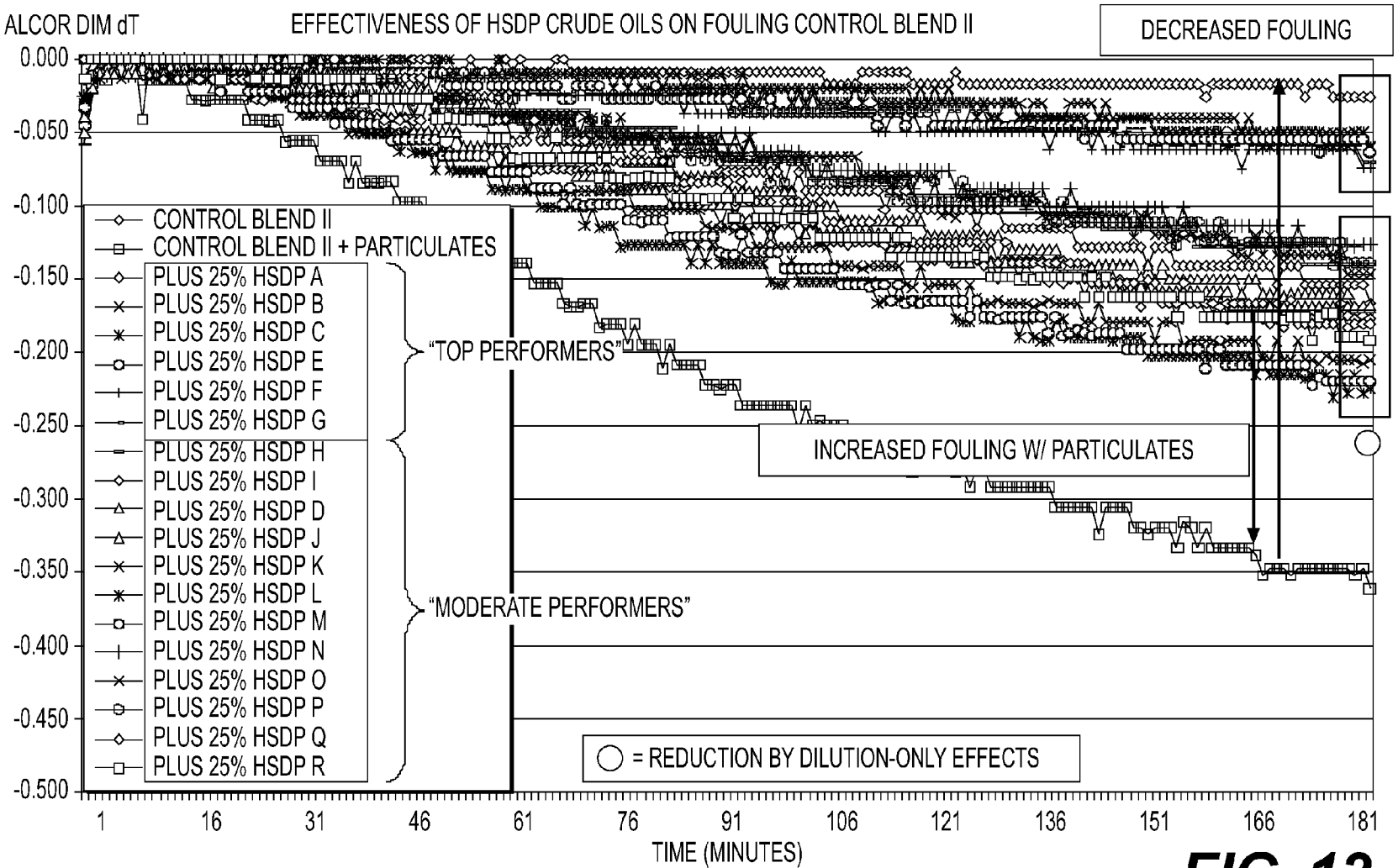
FIG. 12 is a graph illustrating test results showing reduced fouling associated with a crude oil fouling control blend when blended with a various top and moderate performing HSDP Crude Oils (A-R) in accordance with this invention.

Refinery evaluations can be used to define concentrations needed to facilitate on-line cleaning behavior. The effectiveness of each of the HSDP crude oils listed in Table 2 were determined using Alcor testing procedures, as described above. FIGS. 11 and 12 provide the Alcor Dimensionless Delta T from tests carried out on two different fouling control blends with 25% of the total volume of each HSDP blend A through R. As above, any known or suitable technique can be used to blend an HSDP crude oil with a base crude oil. Dimensionless Delta T factors in heat transfer characteristics (viscosity, density, heat capacity, etc.) of the oil and environmental conditions (e.g., fluctuating room temperatures) that could have a slight impact on the maximum oil outlet temperatures achieved. Dimensionless dT corrects for these different heat transfer impacts. This correction is achieved by dividing ΔT (i.e., TOUTLET−TOUTLETMAX) by a measure of heat transferred from the rod during each experiment, which is simply the rod temperature minus maximum outlet temperature, as shown below:

$$\dim dT=(T\text{OUTLET}-T\text{OUTLETMAX})/(T\text{ROD}-T\text{OUTLETMAX})$$

Figure 13:
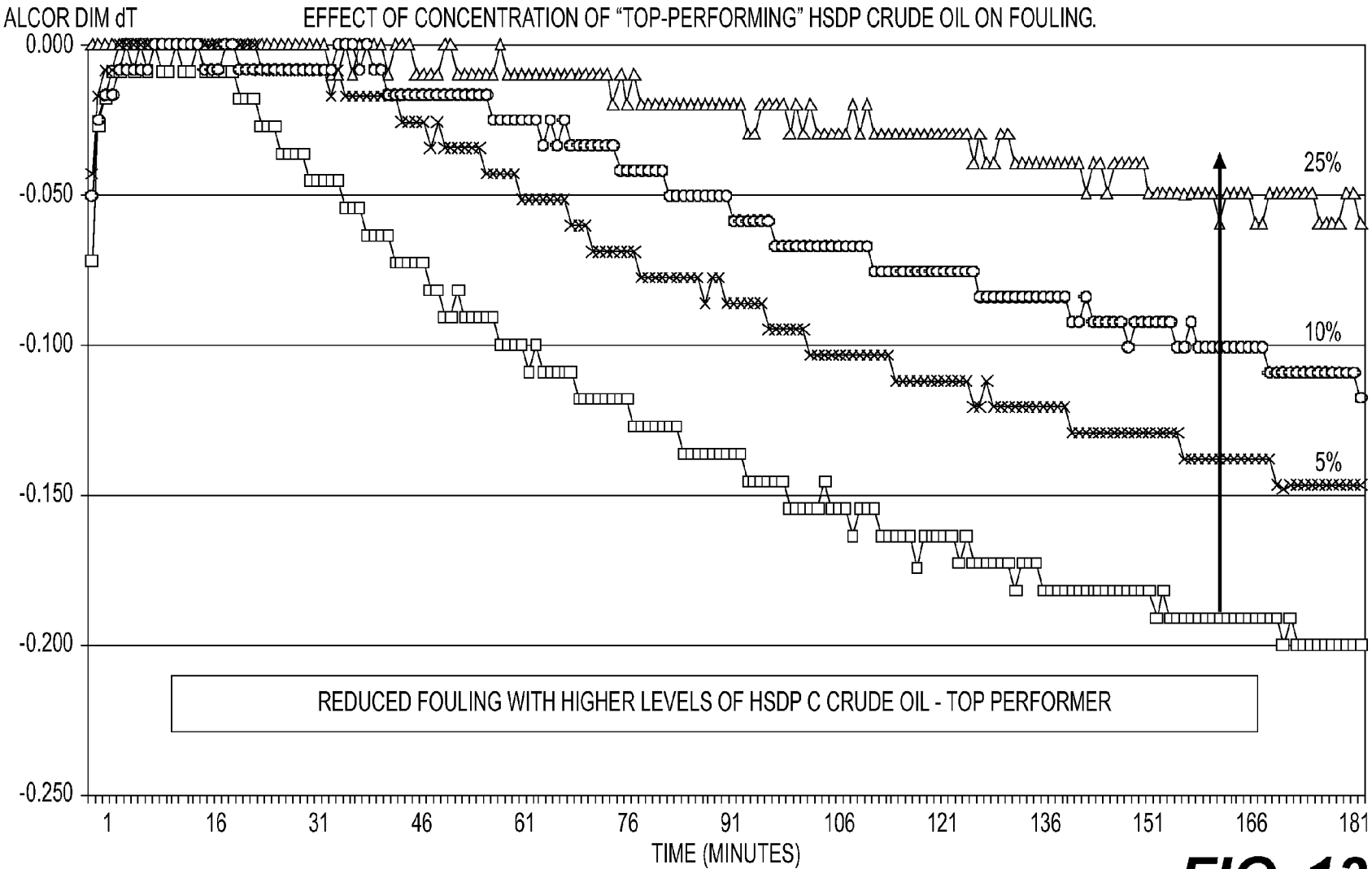
FIG. 13 is a graph illustrating test results showing the effect of different concentrations of a top performing HSDP Crude Oil blend in accordance with this invention.
Figure 14:
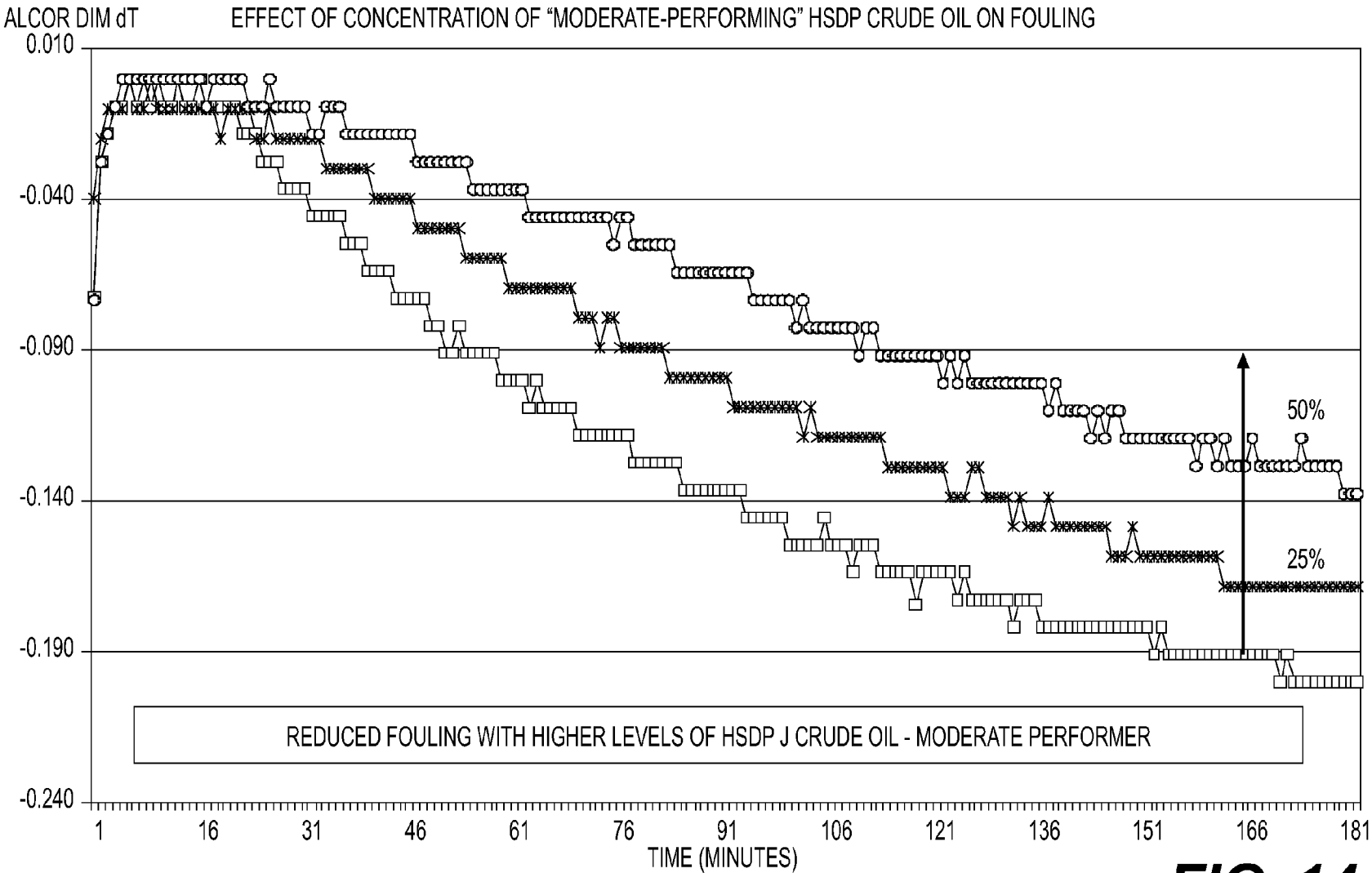
FIG. 14 is a graph illustrating test results showing the effect of different concentrations of a moderate performing HSDP Crude Oil blend in accordance with this invention.

FIGS. 13 and 14 illustrate the performance difference between top-performing and moderate-performing HSDP crude oils. As shown in FIG. 13, the top-performing HSDP crude oil is effective to reduce fouling with concentrations as low as three percent (3%). It is contemplated that still lower concentrations can be used with a lower reduction in fouling. The reduction in fouling increases when the concentration is increased to ten percent (10%) or twenty five percent (25%) of the total volume of the blend. The present invention is not intended to be limited to the concentrations illustrated in FIG. 13; rather, concentrations of top performing HSDP crude oil between the concentrations identified in FIG. 13 are well within the scope of the present invention, as well as concentrations greater than twenty five percent (25%). To achieve more effective levels of reduced fouling using a "moderate-performing" HSDP crude oil, a relatively higher concentration of the HSDP crude oil is necessary than when using a "top-performing" HSDP crude oil. As shown in FIG. 14, higher concentrations of the moderate performing HSDP crude oil are required in order to reduce fouling. Concentrations of twenty five percent (25%) and fifty percent (50%) of a moderate performing HSDP crude oil are effective to reduce fouling. The present invention is not intended to be limited to the concentrations illustrated in FIG. 14; rather, concentrations of moderate performing HSDP crude oil between the concentrations identified in FIG. 14 are well within the scope of the present invention, as well as concentrations greater than fifty percent (50%).

Figure 15:
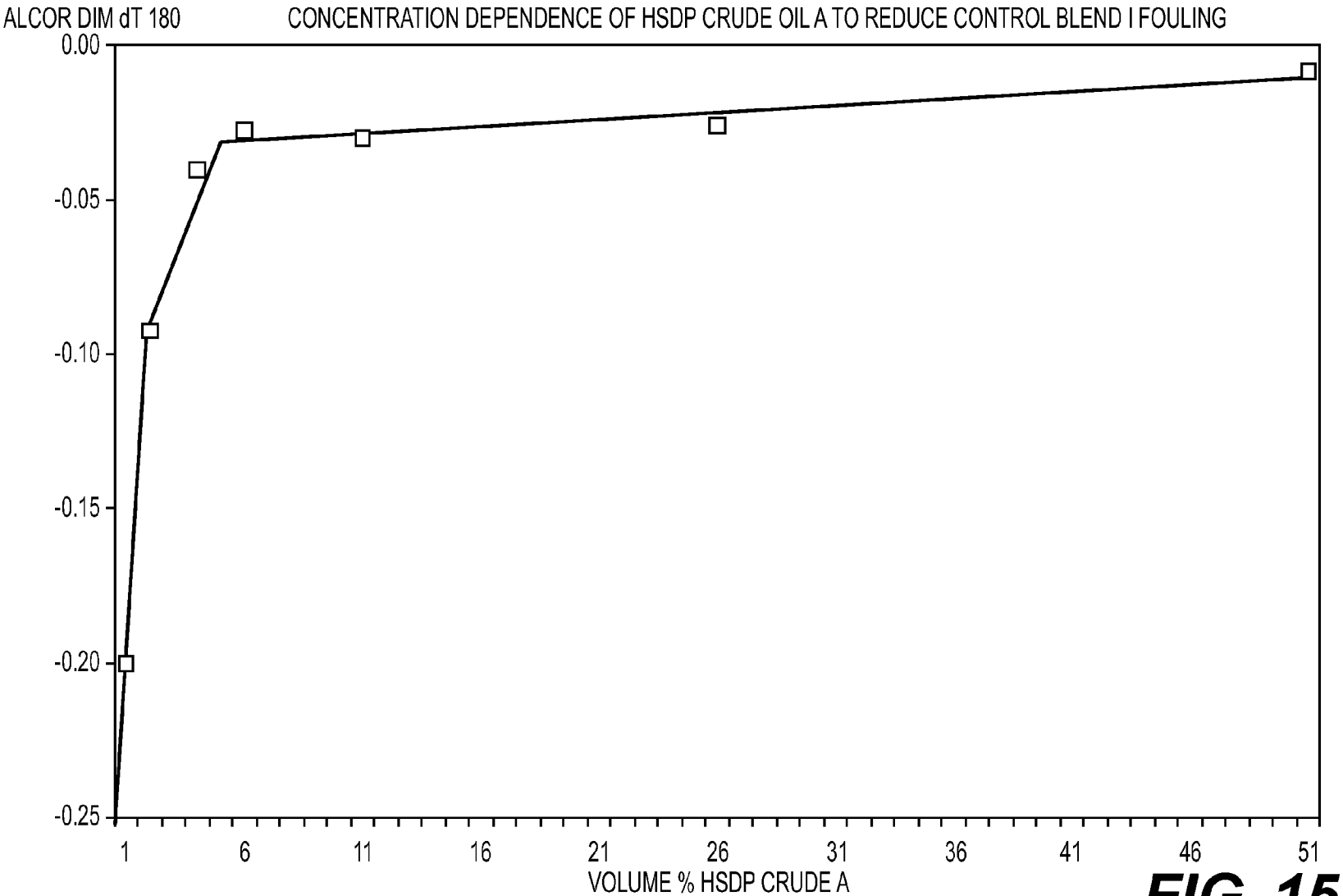
FIG. 15 is a graph illustrating test results showing the concentration dependence of an HSDP Crude Oil on reduction of fouling.
Figure 16:
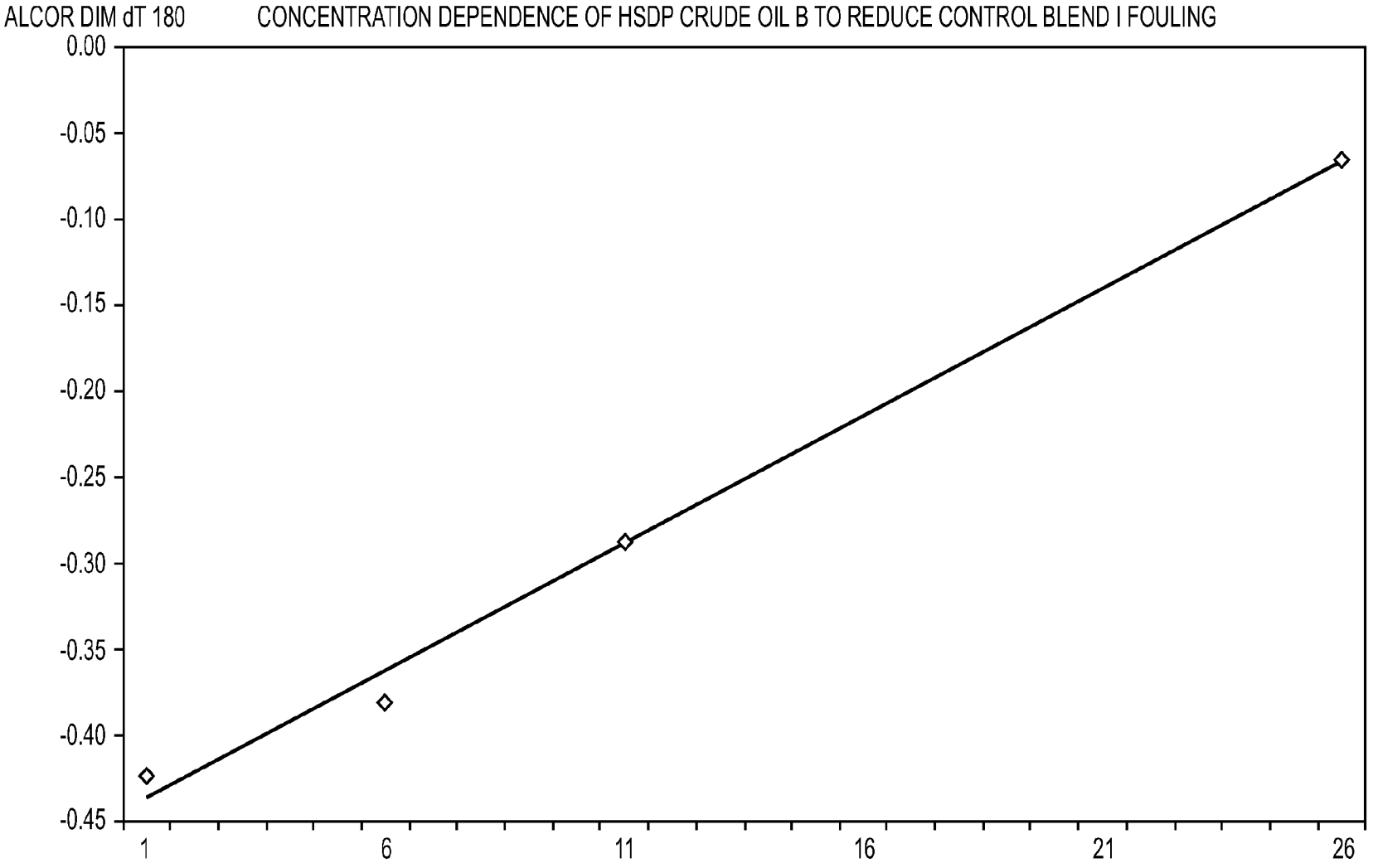
FIG. 16 is a graph illustrating test results showing the concentration dependence of an HSDP Crude Oil on reduction of fouling.

As shown in FIGS. 15 and 16, performance of HSDP crude oils in reducing fouling is dependent upon the concentration of the HSDP crude oil. FIGS. 15 and 16 plot final Alcor dimensionless ΔT levels after 180 minutes of run time. As shown in FIG. 15, top-performing HSDP crude oil is effective to reduce fouling with as little as about 2 percent of HSDP crude oil A in the blend.

The concentration of HSDP crude oil suitable to effectively mitigate fouling of other crude oils was determined using the Alcor testing approach described above. As demonstrated by the Alcor testing of top and moderate performing HSDP crude oils, low levels of top-performing crude oils are effective for mitigating fouling of crude oil refinery components. Levels of top performing HSDP crude oil as low as 2-25 percent the total volume of the blend are effective. For example, as shown in FIG. 15, as little as two percent (2%) of top performing HSDP crude oil is effective to significantly reduce fouling. Higher levels of moderate performing HSDP crude oil of from about 10-50 percent of the total volume of the blend are similarly effective. For example, as shown in FIG. 16, at least about twenty-five percent (25%) of moderate performing HSDP crude oil is effective to significantly reduce fouling. Preferably one or more HSDP crude oils are blended into a blended crude oil in an amount of from 2 to 50 percent of the total volume of the blend. More preferably, the one or more HSDP crude oils are blended in an amount of from 3 to 25 percent of the total volume of the blend. In accordance with another aspect of the invention, the one or more HSDP crude oils can be blended in an amount of from about 5 to 10 percent of the total volume of the blend or from 10 to 50 percent of the total volume of the blend.

In accordance with another aspect of the present invention, a system is provided that is capable of experiencing fouling conditions associated with particulate or asphaltene fouling. The system generally includes at least one crude oil refinery component and a blend in fluid communication with the crude oil refinery component. The blend includes a blend of a base crude oil and a predetermined amount of a high solvency dispersive power (HSDP) crude oil, the HSDP crude oil having a total acid number (TAN) of at least 0.3 mg KOH/g and a solubility blending number ($S_{BN}$) of at least 90.

Particularly, it has also been discovered to use HSDP crude oils to perform on-line cleaning of already fouled crude preheat train exchangers and other refinery components to improve heat transfer efficiencies and recovered furnace coil-inlet-temperatures (CITs). CIT levels of both atmospheric and vacuum pipestill furnaces have been found to increase dramatically when running HSDP crude oils, resulting in energy savings and environmental benefits as a result of reduced fired heating needs. As with co-blending for fouling mitigation, the on-line heat exchanger cleaning efficiency is dependent on the HSDP crude oil and its concentration.

Figure 17:
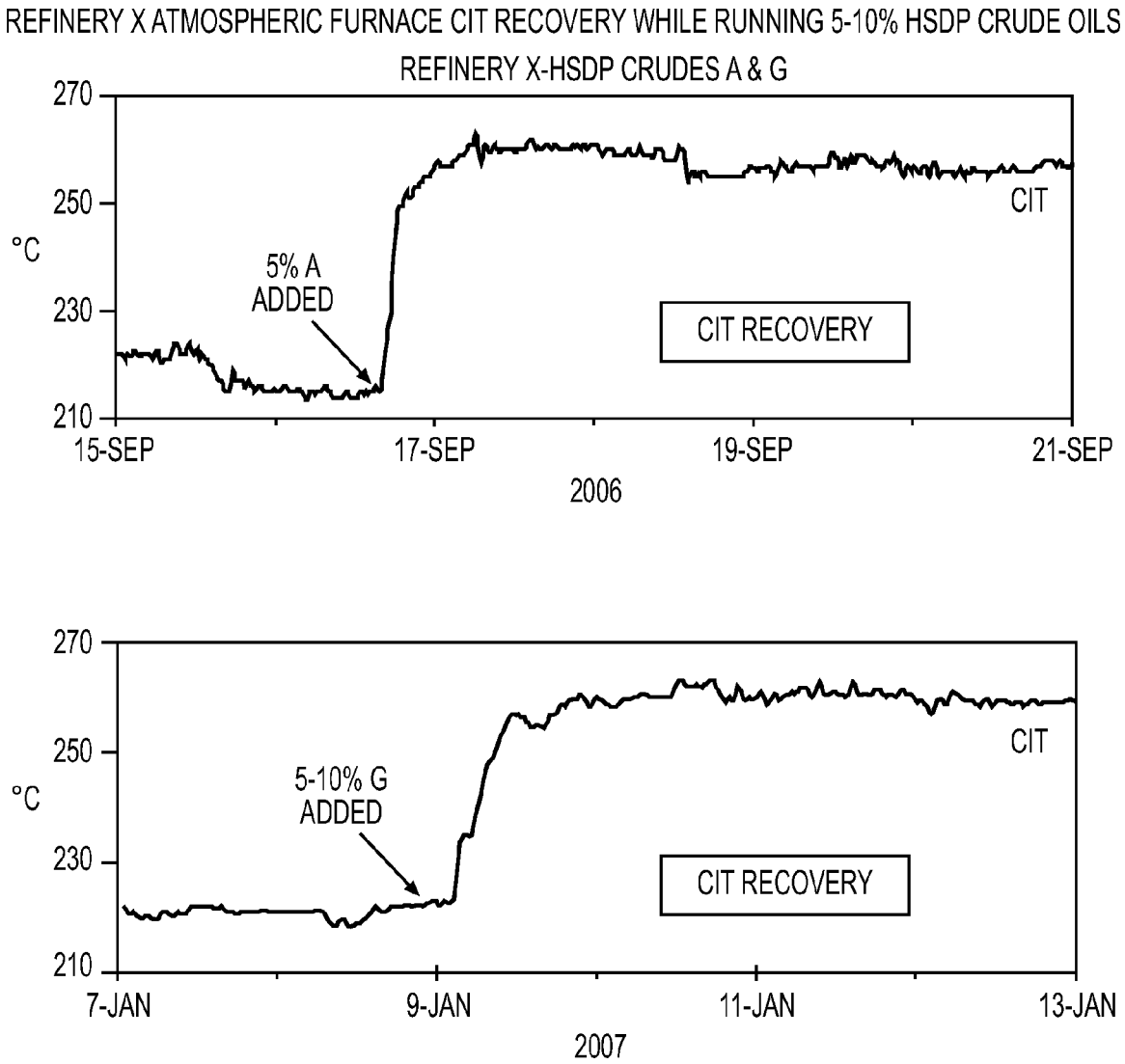
FIG. 17 is a graph illustrating the use of top performing HSDP Crude Oils for on-line cleaning of a fouled heat exchanger.
Figure 18:
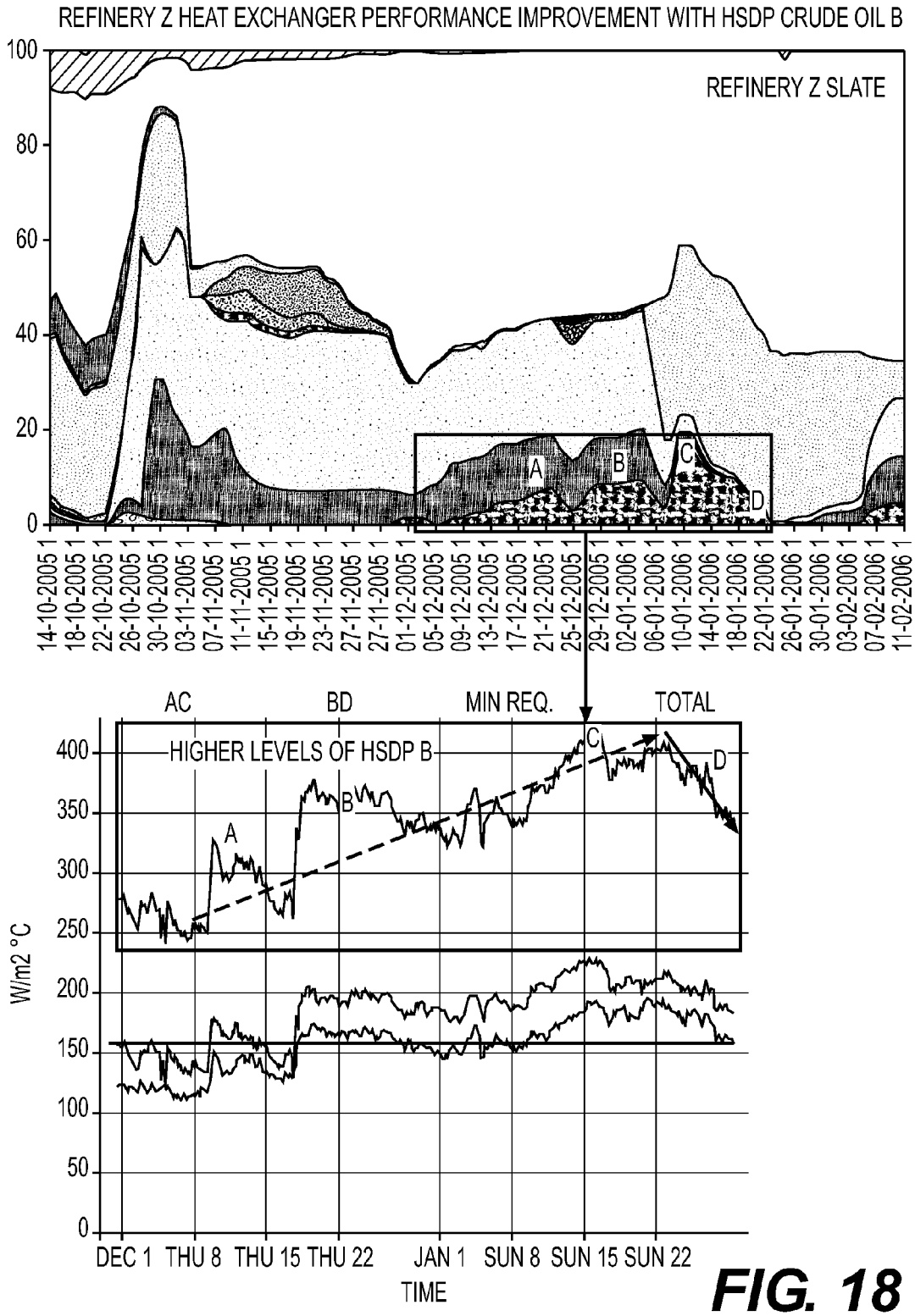
FIG. 18 is a graph illustrating the use of HSDP Crude Oil for on-line cleaning of a fouled heat exchanger.

As shown in FIGS. 17 and 18, varying levels of HSDP crude oils have been shown to be effective in cleaning an already fouled crude oil refinery component, such as a heat exchanger. Fouled exchangers result in reduced furnace (atmospheric and vacuum) coil-inlet-temperatures (CITs), which requires additional firing resulting in increased energy demands and costs. The HSDP crude oils of the present invention have been shown to remove the foulant from already fouled refinery components. As shown in FIGS. 17 and 18, addition of a top-performing HSDP crude oil to a fouled heat exchanger resulted in recovered CIT levels, thereby reducing the energy required to fire the furnace. The recovery in CIT shown in FIG. 17 was 40° C. and occurred within a period as short as about 1 to 2 days of introducing the HSDP crude oil into the blend. FIG. 18 shows heat exchanger performing improvement upon addition of HSDP crude oil B in amounts varying from 2 to 20 percent.

Figure 19:
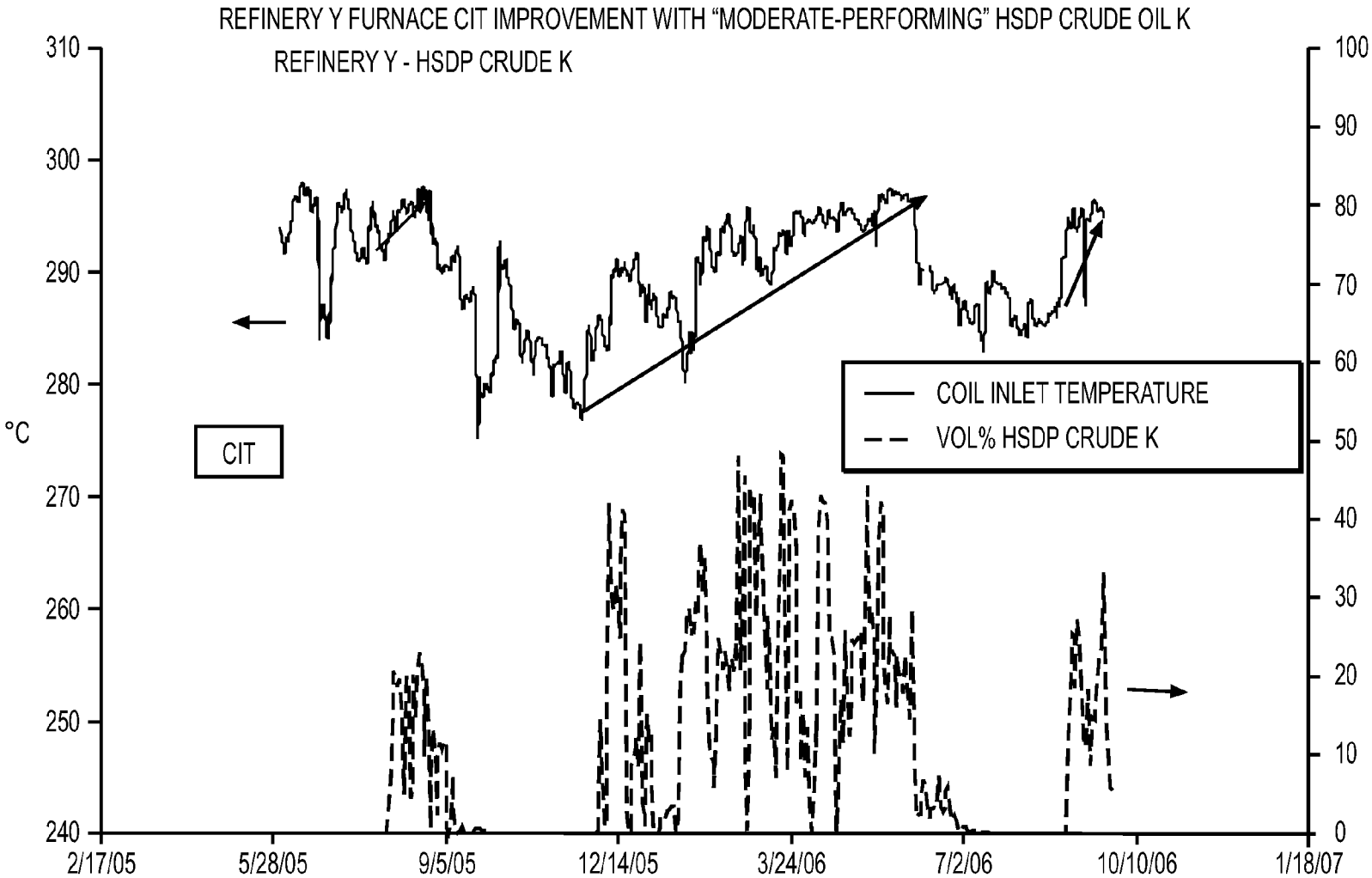
FIG. 19 a graph illustrating the use of moderate performing HSDP Crude Oil for on-line cleaning of a fouled heat exchanger.

As shown in FIG. 19, a moderate performing HSDP crude oil is effective in cleaning an already fouled heat exchanger. The improvements in CIT observed were up to 20° C. when adding between about twenty percent (20%) and forty percent (40%) of moderate performing HSDP crude oil K. As shown in FIGS. 17 and 19, higher levels of moderate performing HSDP crude oils are required to obtain the same heat exchanger recovery obtained with lower levels of top performing HSDP crude oil.

It will be apparent to those skilled in the art that various modifications and/or variations can be made without departing from the scope of the present invention. It is intended that all matter contained in the accompanying specification shall be interpreted as illustrative only and not in a limiting sense. While the present invention has been described in the context of the heat exchanger in a refinery operation, the present invention is not intended to be so limited; rather it is contemplated that the present invention is suitable for reducing and/or mitigating fouling in other refinery components including but not limited to pipestills, cokers, visbreakers and the like.

Furthermore, it is contemplated that the use of a HSDP crude oil, as described in connection with the present invention, can be combined with other techniques for reducing and/or mitigating fouling. Such techniques include, but are not limited to, (i) the provision of low energy surfaces and modified steel surfaces in heat exchanger tubes, as described in U.S. patent application Ser. Nos. 11/436,602 and 11/436,802, the disclosures of which are incorporated herein specifically by reference, (ii) the use of controlled mechanical vibration, as described in U.S. patent application Ser. No. 11/436,802, the disclosure of which is incorporated herein specifically by reference (iii) the use of fluid pulsation and/or vibration, which can be combined with surface coatings, as described in U.S. patent application Ser. No. 11/802,617, filed on Jun. 19, 2007, entitled "Reduction of Fouling in Heat Exchangers," the disclosure of which is incorporated herein specifically by reference (iv) the use of electropolishing on heat exchanger tubes and/or surface coatings and/or modifications, as described in U.S. patent application Ser. No. 11/641,754, the disclosure of which is incorporated herein specifically by reference and (v) combinations of the same, as described in U.S. patent application Ser. No. 11/641,755, filed on Dec. 20, 2006, entitled "A Method of Reducing Heat Exchanger Fouling in a Refinery," the disclosure of which is incorporated herein specifically by reference. Thus, it is intended that the present invention covers the modifications and variations of the method herein, provided they come within the scope of the appended claims and their equivalents.

While a particular form of the invention has been described, it will be apparent to those skilled in the art that various modifications can be made without departing from the spirit and scope of the invention.

Accordingly, it is not intended that the invention be limited except by the appended claims. While the present invention has been described with reference to one or more particular embodiments, those skilled in the art will recognize that many changes can be made thereto without departing from the spirit and scope of the present invention. Each of these embodiments and obvious variations thereof is contemplated as falling within the spirit and scope of the claimed invention, which is set forth in the following claims.

What is claimed is:

1. A system capable of experiencing fouling conditions associated with particulate or asphaltene fouling, comprising:

at least one crude oil refinery component capable of treating a base crude oil having an inlet for the base crude oil;

a source of a high solvency dispersive power (HSDP) crude oil having a total acid number (TAN) of at least 0.3 mg KOH/g and a solubility blending number ($S_{BN}$) of at least 90, in fluid communication with said crude oil refinery component and fed into the inlet of the crude oil refinery component with the base crude oil as a blend in a predetermined amount that is effective to clean the crude oil refinery component.

2. The system of claim 1, wherein the predetermined amount is from 3 to 50 percent of the total volume of the blend.

3. The system of claim 1, wherein the predetermined amount is from 3 to 25 percent of the total volume of the blend.

4. The system of claim 1, wherein the predetermined amount is from 5 to 10 percent of the total volume of the blend.

5. The system of claim 1, wherein the predetermined amount is from 10 to 50 percent of the total volume of the blend.

6. The system of claim 1, wherein the base crude oil is one of a whole crude oil and a blend of at least two crude oils.

7. The system of claim 1, wherein the crude oil refinery component is selected from: heat exchanger, furnace, distillation column, scrubber, reactor, liquid-jacketed tank, pipestill, coker, and visbreaker.

* * * * *